United States Patent [19]

Brackmann et al.

[11] 4,386,617

[45] Jun. 7, 1983

[54] TOBACCO STEM SHREDDING

[75] Inventors: Warren A. Brackmann, Cooksville; Stanislav M. Snaidr, Mississauga, both of Canada

[73] Assignee: Rothmans of Pall Mall Canada Limited, Don Mills, Canada

[21] Appl. No.: 244,083

[22] Filed: Mar. 16, 1981

[30] Foreign Application Priority Data

Mar. 24, 1980 [GB] United Kingdom ..... 8009823
Jun. 12, 1980 [GB] United Kingdom ..... 8019273

[51] Int. Cl.[3] ..... A24B 3/18; A24B 5/16

[52] U.S. Cl. ..... 131/290; 131/291; 131/315; 131/352; 131/300; 131/303

[58] Field of Search ..... 131/290, 291, 302, 303, 131/315, 352

[56] References Cited

U.S. PATENT DOCUMENTS

| | | | |
|---|---|---|---|
| 3,204,641 | 9/1965 | Jones | 131/291 |
| 3,690,328 | 9/1972 | Quaranghi | 131/291 |
| 3,881,498 | 5/1975 | Wochnowski | 131/302 |
| 4,094,323 | 6/1978 | Frazier et al. | 131/360 |
| 4,195,646 | 4/1980 | Kite | 131/290 |

FOREIGN PATENT DOCUMENTS

| | | |
|---|---|---|
| 78349 | 2/1894 | Fed. Rep. of Germany . |
| 954136 | 12/1952 | Fed. Rep. of Germany . |
| 2731931 | 1/1978 | Fed. Rep. of Germany . |
| 2388512 | 4/1977 | France . |
| 2373239 | 7/1978 | France . |
| 48-10240 | 4/1973 | Japan . |
| 49-124299 | 11/1974 | Japan . |
| 54-14598 | 2/1979 | Japan . |
| 950370 | 2/1964 | United Kingdom . |
| 951485 | 3/1964 | United Kingdom . |
| 1153120 | 5/1969 | United Kingdom . |
| 1284795 | 8/1972 | United Kingdom . |
| 1497514 | 1/1978 | United Kingdom . |
| 1564443 | 4/1980 | United Kingdom . |

*Primary Examiner*—V. Millin
*Attorney, Agent, or Firm*—Sim & McBurney

[57] ABSTRACT

Novel shredded tobacco stem material having a much lower burn rate than other stem material and other beneficial properties and useful in the formation of cigarettes is formed by a novel procedure which produces only a relatively minor proportion of particulate material. The procedure, which is also applicable to tobacco stalk and tobacco winnowing, involves an initial thorough soaking of the stem, stalk or winnowings to a relatively high moisture level and mechanical fiberizing of the soaked material in a disc refiner at atmospheric pressure and preferably at ambient temperatures. The resulting shredded stem, stalk or winnowings in fibrous form is dried to the desired moisture level.

25 Claims, No Drawings

TOBACCO STEM SHREDDING

FIELD OF INVENTION

The present invention is concerned with the shredding of tobacco stems, stalks and winnowings to fibrous forms, and to novel shredded stem material.

BACKGROUND TO THE INVENTION

In the manufacture of cigarettes, tobacco leaf is processed to separate the stems from the lamina. The lamina are shredded and formed into cigarettes or other smoking articles. The stems are not successfully utilizable as such in cigarette making because of their relatively large diameter, their hard nature and poor burning properties.

Nevertheless, tobacco stem material constitutes a substantial proportion of the leaf, usually about 20 to 25% of the weight thereof, and contains tar, nicotine and other materials common to the lamina. In the past, therefore, efforts have been made to process the stem material for use in smoking articles but such procedures have generally been unsatisfactory, unsuccessful or inefficient.

One prior art procedure which has been adopted, involves passing the stems, usually after moistening to about 30 wt.% moisture, between rollers which act to crush the stems into sheet material, and cutting the sheet material into shreds for mixing with shredded lamina from which the smoking article is made. The product of this operation is commonly termed "cut rolled stem" (CRS). Cut rolled stem suffers from the drawbacks that it has only limited filling power, i.e., it has a limited ability to fill a cigarette tube, and hence more material is required to be present in the cigarette tube to achieve the same hardness of cigarette than for a higher filling power material.

A variation of this prior art procedure involves soaking and fast drying of the cut rolled stem, which produces a product commonly known as "enhanced cut rolled stem" which has an improved filling power as compared with the cut rolled stem.

Another prior art procedure is described in U.S. Pat. No. 4,094,323 assigned to American Brands Inc. wherein the stem material first is conditioned at a temperature of 115° to 170° C. under a superatmospheric pressure and thereafter is fiberized and expanded using a pressurized shredder comprising closely-spaced counter-rotating ribbed plates at an elevated temperature of about 115° to 170° C. This procedure produces a fiberized and expanded stem material having a substantially improved filling power when compared with cut rolled and enhanced cut rolled stem.

However, this latter prior art procedure also produces a considerable proportion of fine particulate material or "dust", as determined by passing through an 18-mesh sieve, usually about 30 wt.%, which is less suitable for use directly in cigarette making. The particulate material may be separated from the fiberized expanded stem prior to utilization of the latter and may be used to form reconstituted tobacco sheet, but such a procedure is not always available and also means additional processing. The properties ascribed to the fiberized stem material in U.S. Pat. No. 4,094,323 are determined after separation of the fine particulate material.

In addition, while the fiberized and expanded stem material have a substantially improved filling power, when compared with CRS or enhanced CRS, other properties of the product are less satisfactory from the point of view of utility. The burn rate of the material is substantially increased with respect to CRS and enhanced CRS, meaning that, while a lesser combined weight of shredded tobacco lamina and stem may be used in the cigarette for the same overall hardness as a blend of shredded tobacco lamina and CRS, nevertheless, the increase in burning rate of the cigarette which results from the lesser overall amount of tobacco and the increased burning rate of the fiberized and expanded stem material is detrimental.

Furthermore, the pressure drop which results along a cigarette made therefrom is substantially greater than for a cigarette made from enhanced CRS which in turn is greater than for a cigarette made from CRS, under the same cigarette conditions. The pressure drop along the cigarette relates to the ability of the smoker to draw smoke from the cigarette into his mouth, and lower values are generally considered more satisfactory than higher values.

The problem to which the present invention is directed is the production of a shredded stem material having a decreased burn rate compared with CRS, enhanced CRS and the fiberized enhanced stem and an improved filling power when compared with CRS and enhanced CRS while not significantly adversely affecting the pressure drop characteristics when compared with CRS, while at the same time avoiding the production of large amounts of fine particulate matter during the shredded stem formation.

In accordance with one embodiment of the present invention, there is provided a novel shredded tobacco stem material in substantially fibrous form which is characterized by a burn rate of less than about 70 mg/min, preferably about 40 to about 60 mg/min.

The term "burn rate" as used herein with reference to the product of the invention and other processed stem material refers to the rate of burning of the material when formed into a cigarette having a diameter of 7.95 mm, a moisture level of 12.5 wt.% and a density of 0.215 g/cc wrapped in non-porous phosphate cigarette paper.

When formed into a cigarette, the novel stem material also produces a carbon monoxide content in the smoke of 0.47 to 1.14 mg per puff, as determined by Canadian Standard smoking procedures leaving a 30 mm butt.

The novel shredded tobacco stem material also usually exhibits specific pressure drop and filling power characteristics when formed into a cigarette. The novel shredded tobacco material usually exhibits a pressure drop through the tobacco portion of the cigarette of 2.5 to 3.5 cm of water at a flow rate of 17.5 ml/sec, a cigarette density of 0.215 g/cc and a cigarette length of 85 mm. The filling power of such stem material usually is 5.2 to 6.0 g/cc.

The novel shredded stem material is formed by a novel shredding method, which may also be used for tobacco stalk material and cigarette making machine winnowings, which forms a second embodiment of the invention. In accordance therewith, a mass of tobacco stem, stalk or winnowings is treated with water to uniformly distribute water throughout the mass and to thoroughly soak the tobacco stem, stalk or winnowings within the mass to provide an overall moisture content of about 30 to about 60% by weight. The soaked stem, stalk or winnowings is mechanically fiberized between closely-spaced fiberizing surfaces at atmospheric pressure to form shredded tobacco stem, stalk or winnowings in substantially fibrous form. The shredded material is dried to any desired moisture content.

That latter procedure, while producing a shredded stem product of novel characteristics, also produces considerably less particulate material, typically about 20 wt.% thereof passes through an 18-mesh screen, than the prior art procedure of U.S. Pat. No. 4,094,323. This significantly decreased proportion of fine particles permits the whole of the processed material to be utilized without the necessity for the separation of the small particles, since the quantity and characteristics of the particulate material present does not significantly adversely affect the properties of the shredded material and the properties specified herein are those for the whole of the shredded material. It has been found, however, that properties of the shredded material, in particulate burn rate and filling power, are further improved, if the fine particulate material is removed from the shredded material. The necessity to discard or further treat a significant proportion of the shredded material, such as occurs in the prior art procedure of U.S. Pat. No. 4,094,323, is eliminated.

GENERAL DESCRIPTION OF INVENTION

1. Novel Shredded Tobacco Stem Product

As noted above, the present invention, in one embodiment, provides a novel shredded tobacco stem material in substantially fibrous form. This product is a unique shredded tobacco stem material in that it possesses a burn rate of less than about 70 mg/min and preferably about 40 to about 60 mg/min.

This burn rate is significantly less than cut rolled stem, typically about 80 mg/min, enhanced cut rolled stem, typically about 75 mg/min, and the fiberized expanded stem of U.S. Pat. No. 4,094,323, typically about 82 mg/min. Generally, the burn rate of the novel shredded tobacco stem material is at least about 20%, preferably about 30 to about 50%, slower than that of CRS and at least about 10% better than enhanced CRS made of the same type of stem material under the same cigarette burning conditions.

The significance of the lower burn rate is that a lighted cigarette containing the product of the invention, using in a blend of from about 2 to about 50% by weight thereof with shredded tobacco lamina, burns slower than a cigarette containing the same weight of a blend of any other of the prior art stem materials with tobacco lamina. Accordingly, less tobacco lamina needs to be used to get the same burn rate as prior art blends, thereby realizing tobacco economy and a lesser tar and nicotine content in the tobacco smoke. Further, it has been found that the lower burn rate also leads to a decrease in the proportion of products of combustion, including tar, nicotine and, as discussed in more detail below, carbon monoxide. Hence, further decreases in tar and nicotine content of the tobacco smoke from blends with tobacco lamina can be achieved.

The shredded stem material of this invention when made into a cigarette produces a carbon monoxide content in the smoke which is significantly less per puff of smoke than the carbon monoxide content of CRS and enhanced CRS. Generally, the carbon monoxide content in the smoke is at least about 20% less than that of CRS.

It has been common practice to perforate cigarette paper to dilute the carbon monoxide in the tobacco smoke with air drawn through the perforations and to add flavour to the tobacco to compensate for that lost as a result of dilution of the tobacco smoke.

In view of the lower carbon monoxide content of the smoke produced by cigarettes containing the novel shredded stem material of this invention, the necessity for such manipulation may be decreased or even eliminated.

The carbon monoxide content of the smoke which is produced from a cigarette consisting of the novel shredded stem material is 0.47 to 1.14 mg per puff of smoke, when determined as described above. These values compare with a typical value for CRS of about 2.5 mg per puff and for enhanced CRS of about 1.9 mg per puff under the same burning conditions.

These beneficial results of decreased burn rate and decreased carbon monoxide and other combustion products content of smoke are exhibited by the novel product of the invention while at the same time increasing filling power when compared to CRS and enhanced CRS and decreasing pressure drop when compared with enhanced CRS and with the fiberized and expanded stem material of U.S. Pat. No. 4,094,323.

As mentioned previously, the filling power of a cigarette filler material is important since it determines the quantity of the material required to achieve a given hardness of cigarette. The greater the filling power the less filler material is required to achieve the given hardness.

The novel shredded stem of this invention has a better filling power than CRS and also enhanced CRS, which itself is an improvement over CRS. The improved filling power exhibited by the novel shredded stem material, however, does not attain typical values for the fiberized and expanded stem material of U.S. Pat. No. 4,094,323. However, the filling power exhibited by the latter product is attained at the considerable expense of a significantly increased burn rate when compared with CRS and an increased pressure drop when compared with CRS.

The improved filling power of the product of this invention is accompanied by a significantly decreased burn rate as compared with CRS and a decreased pressure drop as compared with enhanced CRS. Accordingly, the product of this invention may be used to decrease the overall quantity of tobacco used in a cigarette to achieve the same hardness while not increasing the burn rate but rather decreasing it.

The filling power for the product of the invention preferably is about 5.2 to about 6.0 cc/g, as compared with typical values for CRS of 4.0 cc/g, for enhanced CRS of 4.5 cc/g and for fiberized expanded stem (U.S. Pat. No. 4,094,323) of 6.6 cc/g. These filling power results are for the whole of the shredded material. If the particulate material is removed, the filling power is increased by about 10%.

Pressure drop is another significant parameter of the product of this invention. The pressure drop is measured in cm of water at a tobacco industry standard flow rate of 17.5 ml/sec for a cigarette as described above. In view of the fact that a higher pressure drop signifies that a smoker must pull harder on the cigarette to draw smoke into his mouth and that a lower pressure drop permits the filter size to be increased so as to decrease the tar and nicotine content of the cigarettes, lower pressure drop values are considered to be better than higher pressure drop values.

The product of this invention exhibits a pressure drop of less than that for exhanced CRS and for fiberized expanded stem, which themselves tend to be about the same. The pressure drop is greater than that for CRS but not significantly adversely so, especially when the pressure drop is considered in conjunction with filling power, for which the product of this invention is vastly superior to CRS.

The shredded tobacco stem material of this invention, when in cigarette form, preferably exhibits a pressure drop of 2.5 to 3.5 cm of water at a flow rate of 17.5 ml/sec, as compared with a typical value of about 1.3 cm of water for CRS, and a typical value of about 4.1 cm of water for both enhanced CRS and fiberized expanded stem, under the same cigarette conditions.

The novel shredded stem material in substantially fibrous form, therefore, exhibits a combination of parameters which are not shown by any other processed stem material of which the applicants are aware and is able to be used in a more flexible manner in blends with shredded lamina.

2. Method for Formation of Novel Shredded Tobacco Stem Product

As mentioned above, the invention also includes a method for forming shredded tobacco stem, stalk or winnowings. The method includes an initial treatment of a mass of the tobacco stem, stalk or winnowings with water, mechanically fiberizing the treated material at atmospheric pressure, and decreasing the moisture content to a desired level.

(a) Preliminary Treatment of Tobacco Stem, Stalk or Winnowings

In this first step of the process, a mass of tobacco stem, stalk or winnowings, which may first be cut into convenient lengths, for example, about 0.5 to 6 inches, is treated with water.

The water treatment is effected to uniformly distribute water throughout the mass of stem, stalk or winnowings and to thoroughly soak the tobacco stem, stalk or winnowings within the mass to provide an overall moisture content of about 30 to about 60% by weight, preferably about 50 to about 60% by weight.

The procedure involves soaking of the mass of stem, stalk or winnowings in water at atmospheric pressure in such a way as to avoid any substantial loss of water extractible from the mass. This result may be achieved by initially exposing the tobacco mass to water for about 5 to about 15 minutes, so as to permit the mass to soak up the water.

The water has a volume sufficient to permit the desired moisture content to be achieved and may have any convenient temperature up to the boiling point thereof, such as about 15° to about 90° C., higher temperatures speeding up the absorbtion of the water.

Thereafter, the exposed mass is stored in confined manner to permit the soaked up water to permeate through the mass and into the tobacco stem, stalk or winnowings therein and to evenly distribute therethrough. The confinement may be from about 0.25 to about 24 hours, preferably about 1 to about 4 hours.

Alternatively, the tobacco mass may be exposed to water in a suitable conditioning drum for a period sufficient to achieve the desired overall moisture content.

(b) Mechanically Fiberizing the Soaked Stem, Stalk or Winnowings

The mass of soaked stem, stalk or winnowings resulting from the preliminary step is mechanically fiberized between closely-spaced fiberizing surfaces at atmospheric pressure to form shredded tobacco stem, stalk or winnowings in substantially fibrous form.

This mechanical fiberizing step is quite different from that adopted in U.S. Pat. No. 4,094,323 where a superatmospheric pressure and high temperature operation is adopted. In this invention, an atmospheric pressure operation and much lower temperatures are used, leading to simpler equipment and less energy requirement. The effects of these differences are quite significant, in that a shredded stem material is produced in this invention which has properties which are quite different from and superior to those exhibited by the prior art product, as discussed in detail above, and, further, less particulate material is produced in this invention as compared with the prior art.

Apparatus suitable for carrying out the mechanical fiberizing step is a revolving disc refiner, such as are manufactured by Bauer Bros., Sprout-Waldron and American Defibrator. The disc refiner includes two disc-like plates which are closely spaced apart, and at least one has a face pattern designed to fiberize the material fed between the plates.

The disc refiner may be of the type wherein there is a stationary plate and a plate which revolves relative to the stationary plate, or, preferably, of the type wherein the plates rotates in opposite directions. When a single rotary plate is used, the spacing between the plates is usually about 0.001 to about 0.01 inches, while in the case of two counter-rotating plates, the spacing used is about 0.05 to about 0.3 inches, preferably 0.13 to 0.18 inches. The optimum plate-spacing and pattern, rotational speed and retention time are readily determined for a particular tobacco stem, stalk or winnowings and type of disc refiner used. The product resulting from the refiner generally has the appearance and size of shredded tobacco lamina, namely, bundles of loosely integrated fibres.

Some temperature rise results in the mechanical fiberizing step, as a result of the friction between the plate ribs and the tobacco stem, stalk or winnowings. The soaked mass of tobacco stem, stalk or winnowings may be fed to the mechanical fiberizing step at any convenient temperature up to the boiling point of the water.

The effect of such heat on the final product is to increase the filling power and pressure drop parameters and at the same time increase the burn rate. The temperature of the mass, therefore, may be used to vary the parameters possessed by the product.

The temperature usually ranges from about 15° to about 90° C. When lower temperature operations are desired, the temperature of the mass entering the mechanical fiberizing step may vary from about 10° to about 35° C., preferably about 15° to about 25° C.

(c) Drying Fiberized Stem or Stalk Material

The shredded tobacco stem, stalk or winnowings which is formed in the mechanical fiberizing step is dried to a desired moisture level in any desired manner. Usually, the final moisture level is in the range of about 10 to about 16% by weight, preferably about 12 to about 15% by weight, since smoking products, such as, cigarettes, have moisture contents in this range. No initial separation of particulates is required.

The shredded stem, stalk or winnowings may be dried to the final moisture level prior to blending with shredded tobacco lamina, usually in the proportions of about 2 to about 50 wt.% of shredded stem, stalk or winnowings and the balance by weight of shredded tobacco lamina, or may be partially dried to an intermediate moisture level, blended with shredded tobacco lamina at a similar moisture level, and drying the blend to the desired moisture level.

In one preferred embodiment of the invention, the shredded material is discharged directly from the disc refiner in a flowing air stream to maintain the fibres in a substantially separated condition. This action may be combined with cooling of the shredded material by using an air stream having a temperature below that of the exiting shredded material, for example, about 20° to 25° C.

The maintenance of the fibres in a separated condition decreases the incidence of "balling", or the joining together and curling up of the fibres to form ball-like particles which are unusable in the final product. Once the shredded fibres have been discharged from the air stream, for example, using a flexible shell air-lock, they are dried, initially to a moisture level of about 19 to about 35% by weight, using any conventional tobacco drying equipment, such as, a rotary tumbler drier.

Thereafter, any ball-like particles are removed from the fibres by any conventional winnowing technique, such as, by air separation and recycled to the refiner. The shredded stem, stalk or winnowings now may be dried to the final moisture level, or may be blended with shredded tobacco lamina and the blend dried to the final moisture level.

The method embodiment of this invention, therefore, permits shredded tobacco stem, stalk or winnowings in substantially fibrous form to be produced without the substantial production of dust and without the necessity for high pressure and high pressure operation. Further, the shredded tobacco stem material which results is superior in its combination of properties from any other known processed tobacco stem material.

EXAMPLES

Example 1

Tobacco stem material was placed in a conditioning cylinder with water for about 8 minutes before being transferred to a vessel wherein the material was allowed to stand for about 4 hours, at the end of which time the stem material had a moisture content of about 55 wt.%.

The soaked stem material was fed between counter-rotating discs of a double disc refiner rotated at 1200 rpm and open to the atmosphere. The refiner was manufactured by Bauer Bros., the pattern of the plates were those idenfied by Bauer as 325 and 326, and the plate spacing was 0.14 inches. After shredding the material was dried to a moisture content of 14.5 wt.%.

A number of tobacco samples were made up into 850 mg cigarettes using a blend of shredded tobacco lamina and the shredded tobacco stem material produced by the above process (Inventive stem), the shredded stem material alone, shredded tobacco lamina, enhanced CRS and a blend of shredded tobacco lamina and enhanced CRS. The burning rate of the cigarettes were determined under abnormally low moisture levels of about 9 wt.%. The results are reproduced in the following Table I:

TABLE I

| Tobacco Sample | Burning Time (mins.)(1) | Burn Rate(2) (mg/min) |
|---|---|---|
| 100% lamina | 15.6 | 51 |
| 75% lamina + 25% enhanced CRS | 12.5 | 63 |
| 75% lamina + 25% Inventive Stem | 13.5 | 58.9 |
| 100% enhanced CRS | 9.1 | 87 |
| 100% Inventive Stem | 11.8 | 67.4 |

Notes:
(1)Average of 3 runs
(2)These results are higher than normal for all samples because of the relatively low moisture level.

The results of the above Table I demonstrate that the product containing the inventive shredded stem material produced lower burning rates than the corresponding product containing conventional enhanced CRS. It was observed that the ash formed on burning of the cigarettes containing the inventive shredded stem material was much stronger than the ash formed on burning the other cigarettes.

Example 2

Cigarettes were prepared from blends of 74% lamina and 26% of stem material, using, in one case, enhanced cut-rolled stem and, in another case, the inventive shredded stem material. The cigarettes were smoked and determination of tar, nicotine and carbon monoxide in the smoke were made. The results are reproduced in the following Table II:

TABLE II

| Sample | Tar (total mg) | Tar per puff | Nicotine (total-mg) | Nicotine per puff | CO total-mg | CO per puff | No. of Puffs |
|---|---|---|---|---|---|---|---|
| Control with 26% CRS | 15.1 | 1.52 | 1.05 | .106 | 17.9 | 1.80 | 9.9 |
| Cigarette with 26% inventive stem material | 15.5 | 1.52 | 1.06 | .104 | 15.8 | 1.54 | 10.2 |

The results of the above Table II show a significant decrease in carbon monoxide content of the smoke, the difference being 14.4% between the samples. While this decrease in carbon monoxide is obtained, the tar and nicotine values in the smoke remained substantially unaffected in this test.

Example 3

Samples of cigarettes were made prepared under production conditions from mixtures of lamina and stem material as described in Example 2. An increased number of tests were carried out on the samples than was effected in the case of Example 2. The results are reproduced in the following Table III:

TABLE III

| Parameter | Samples: with inventive stem material | Samples: with enhanced cut-rolled stem |
|---|---|---|
| Dry tar mg/cgt | 15.3 | 14.3 |
| Nicotine mg/cgt | 1.03 | 0.81 |
| CO mg/cgt | 16.6 | 19.7 |
| No. of puffs/cgt | 10.8 | 9.5 |
| CO/puff (mg) | 1.54 | 2.07 |
| Tar/puff (mg) | 1.41 | 1.50 |
| Nicotine/puff (mg) | 0.095 | 0.085 |
| Weight - total g | 1.121 | 1.125 |
| - tobacco rod g | 0.965 | 0.968 |
| - filter g | 0.156 | 0.157 |
| Pressure drop - total cm | 11.4 | 12.1 |

TABLE III-continued

| Parameter | Samples: with inventive stem material | Samples: with enhanced cut-rolled stem |
|---|---|---|
| - total rod cm | 5.0 | 5.5 |
| - filter cm | 6.6 | 6.8 |
| Rod diameter mm | 7.95 | 7.96 |
| Free Burn (min. sec/40 mm) | 10:40 | 9:08 |
| Burn rate (mg/min) | 54.0 | 63.2 |
| % Nicotine | 1.58 | 1.49 |
| % Nicotine/puff | 0.146 | 0.146 |
| % Sugar | 18.3 | 17.6 |
| % Sugar/puff | 1.69 | 1.85 |
| % Chloride | 1.39 | 1.64 |
| % Chloride/puff | 0.128 | 0.172 |

The results of the above Table III confirm the superiority of the inventive stem material under production conditions. A slower burning rate is observed along with a lower carbon monoxide content in the cigarette smoke, and a decreased pressure drop.

Example 4

Samples of shredded stem material were again produced following the procedure of Example 1, except that the water in the conditioning drum had a temperature of about 70° C., some soaked samples were shredded at ambient temperature while other soaked samples were shredded at an elevated temperature of about 80° C., and drying was effected in a rotary drier.

The samples were subjected to sieve tests, which showed that about 20 wt.% of the material passed an 18-mesh screen. This fine particulate material was retained with the samples for testing.

Cigarette samples containing a tobacco weight of 865 mg, a tobacco length of 67 mm of which 40 mm was smoked were made up containing Inventive Stem produced at ambient temperature, Inventive Stem produced at elevated temperature, enhanced CRS, CRS and shredded tobacco lamina. The cigarettes were smoked and determinations were made on the smoke. The results are reproduced in the following Table IV:

TABLE IV

| | Inventive Stem (Cold) | Inventive Stem (Hot) | Enhanced CRS | CRS | Tobacco Lamina |
|---|---|---|---|---|---|
| Burn Rate (mg/min) | 54.3 | 60.7 | 76.5 | 86.0 | 50 |
| Tar/Cigarette (mg) | 5.0 | 6.2 | 7.3 | 8.1 | 17.6 |
| Tar/Puff (mg) | 0.46 | 0.62 | 0.99 | 1.26 | 1.72 |
| Nicotine/Cigarette (mg) | 0.2 | 0.23 | 0.16 | 0.16 | 1.36 |
| Nicotine/Puff (mg) | 0.018 | 0.023 | 0.022 | 0.021 | 0.137 |
| CO/Cigarette (mg) | 7.1 | 8.1 | 14.5 | 15.3 | 16.6 |
| CO/Puff (mg) | 0.65 | 0.81 | 1.96 | 2.39 | 1.67 |
| Number of Puffs/Cigarette | 11.0 | 10.0 | 7.4 | 6.4 | 9.9 |
| Pressure Drop (cm of $H_2O$) | 2.7 | 3.5 | 4.3 | 1.3 | 4.4 |
| Bulk Filling Power (cc/g) | 5.6 | 5.7 | 4.5 | 4.0 | |
| Filling Capacity Increase Over Conventional CRS (%) | 40.0 | 42.5 | 12.5 | — | |
| Cigarette Yield Increase Based on Cigarette Firmness | 24.5 | 23.9 | 16.3 | — | |

The results of the above Table IV illustrate the superior combination of properties of both the shredded stem produced at ambient and at elevated temperatures, when compared with CRS and enhanced CRS. Burn rate is significantly decreased, CO, tar and nicotine smoke contents are significantly decreased, the pressure drop is less than enhanced CRS although not as low as CRS and the bulk filling power is significantly greater.

The inventive stem material produced at an elevated temperature feed exhibits a faster burn rate, higher CO, tar and nicotine smoke contents, or higher pressure drop and a higher filling power when compared with the inventive stem material produced at an ambient temperature feed, illustrating the ability to modify the superior properties of the shredded stem material of the invention by altering the refining temperature.

Example 5

A number of 85 mm length cigarette samples were prepared using conventional CRS and inventive stem material, produced under both cold and hot feed conditions to the refiner as described in Example 4. The cigarettes were smoked and, in each case, determination of burning rate and pressure drop were made. The values obtained were compared with each other and also with the values for these parameters as they are set forth in U.S. Pat. No. 4,094,323 for both fiberized and expanded stem and CRS.

The results are reproduced in the following Table V wherein the density for shredded stem and fiberized stem cigarettes was 0.215 g/cc while that for CRS cigarettes was 0.293 g/cc.

TABLE V

| | Inventive Stem: Cold | Inventive Stem: Hot | Fiber Stem U.S. Pat. No. 4,094,323 | Conventional CRS: U.S. Pat. No. 4,094,323 | Conventional CRS: Same Stem |
|---|---|---|---|---|---|
| Burn Rate (mg/min) | 50.2 | 55.6 | 83.6 | 75.5 | 79.9 |
| Pressure Drop (cm of Hg) | 2.6 | 3.2 | 4.1 | 4.1 | 3.8 |

The results of the above Table V show the very much lower burning rate attained by the shredded stem material of this invention, produced from either a cold feed or a hot feed to the disc refiner, when compared with the other products.

The pressure drop for the inventive material is less than for enhanced CRS and fiberized expanded material produced by the procedure of U.S. Pat. No. 4,094,323.

Example 6

The filling power of shredded stem material produced from both a cold feed and a hot feed as described in Example 4 was determined both for samples wherein particulate material passing an 18-mesh screen was sieved from the material and for samples wherein the particulate material was retained. These values were compared with those set forth in U.S. Pat. No. 4,094,323 for fiberized and expanded stem at a density of 0.215 g/cc and with those for conventional CRS as set forth in U.S. Pat. No. 4,094,323 and as produced from the same stem material at a density of 0.293 g/cc.

The results are reproduced in the following Table VI:

TABLE VI

| | Inventive Stem | | Fiber Stem U.S. Pat. No. 4,094,323 | Conventional CRS U.S. Pat. No. 4,094,323 | Conventional CRS Same Stem |
|---|---|---|---|---|---|
| | Cold | Hot | | | |
| Filling Capacity (cc/g) (Sieved material) | 6.07 | 6.24 | 6.65 | 4.4 | 4.0 |
| Filling Capacity Increase Over Conventional CRS (%) | 51.7 | 56.0 | 51.1 | — | — |
| Filling Capacity (cc/g) (non-sieved material) | 5.6 | 5.7 | — | — | 4.0 |
| Filling Capacity Increase Over Conventional CRS | 40.0 | 42.5 | — | — | — |

As can be seen from the results set forth in Table VI, the sieving out of the fine particulates from the shredded stem material improves the filling power thereof by about 10%. The % increase in filling power over the base CRS material for the sieved inventive stem material exceeds % increase in filling power of the sieved fiberized and expanded stem material of U.S. Pat. No. 4,094,323 over the CRS material described therein.

SUMMARY OF DISCLOSURE

In summary of this disclosure, the present invention provides a novel shredded tobacco stem material useful in manufacture of cigarettes and a novel method for the formation of shredded tobacco stem and stalk material which produces less waste product and requires relatively mild processing conditions. Modifications are possible within the scope of this invention.

What we claim is:

1. Shredded tobacco stem material in substantially fibrous form characterized by a burn rate which is at least about 20% less than that of cut-rolled stem material made from the same type of stem material under the same cigarette burning conditions.

2. The product of claim 1 wherein said burn rate is about 20 to about 50% less than that of the cut-rolled stem material.

3. A smoking article comprising a blend of about 50 to about 98 wt.% of shredded tobacco lamina and from 2 to about 50 wt.% of the shredded tobacco stem material of claim 1.

4. Shredded tobacco stem material in substantially fibrous form characterized by a burn rate of less than 70 mg/min when formed into a cigarette having a diameter of 7.95 mm, a moisture level of 12.5 wt.%, and density of 0.215 g/cc wrapped in a non-porous cigarette paper.

5. The product of claim 4 further characterized by a carbon monoxide content of smoke from burning a cigarette formed therefrom of 0.47 to 1.14 mg per puff of smoke, as determined by Canadian Standard smoking procedures.

6. Shredded tobacco stem material in substantially fibrous form characterized by:

(a) a burn rate of from about 40 to about 60 mg/min when formed into a cigarette having a diameter of 7.95 mm, a moisture level of 12.5 wt.%, and a density of 0.215 g/cc wrapped in a non-porous cigarette paper, (b) a carbon monoxide content of smoke from burning a cigarette formed therefrom of 0.47 to 1.14 mg per puff of smoke, as determined by Canadian Standard smoking procedures, (c) a pressure drop of 2.5 to 3.5 cm of water at a flow rate of 17.5 ml/sec through a cigarette formed therefrom having a tobacco length of 85 mm and a density of 0.215 g/cc, and (d) a filling power of 5.2 to 6.0 g/cc.

7. A method of forming shredded tobacco stem, stalk and/or winnowings, which comprises:

treating a mass of tobacco stem, stalk or winnowings with water to uniformly distribute water throughout said mass and to thoroughly soak said tobacco stem, stalk or winnowings within the mass to provide an overall moisture content of about 30 to about 60% by weight, thereby forming a mass of discrete moist particles of tobacco stem, stalk or winnowings, mechanically fiberizing said soaked stem, stalk or winnowings between closely-spaced two counter-rotating fiberizing surfaces spaced about 0.05 to about 0.3 inches apart, said fiberizing being effected at atmospheric pressure and at a temperature up to the boiling point of water to form shredded tobacco stem, stalk or winnowings in substantially fibrous form, and drying said shredded tobacco stem, stalk or winnowings to a desired moisture content.

8. The method of claim 7 wherein said mechanical fiberizing is effected at an initial temperature of about 15° to about 25° C.

9. A method of forming shredded tobacco stem, which comprises:

soaking a mass of tobacco stem material in water at atmospheric pressure to provide a substantially uniform distribution of moisture therethrough at a moisture level of about 30 to about 60% by weight in such manner as to avoid any substantial loss of water extractibles from said mass, mechanically fiberizing said soaked mass of tobacco stem material between two counter-rotating disc-like fiberizing surfaces spaced apart about 0.5 to about 0.3 inches, said fiberizing being effected at atmospheric pressure at a temperature up to the boiling point of water, and drying the fiberized stem material so formed to a moisture content of about 10 to about 16% by weight.

10. The method of claim 9 wherein said soaking step is effected by:

(i) exposing said mass of tobacco stem material to water having a temperature up to the boiling point thereof and having a volume sufficient to permit the desired moisture level to be achieved for about 5 to about 15 minutes thereby to permit said mass to soak up said water, and (ii) storing said exposed mass in a confined manner for about 0.25 to about 24 hours to permit said soaked-up water to permeate through and into the tobacco stem in said mass and to evenly distribute therethrough.

11. The method of claim 10 wherein said water has a temperature of about 15° to about 90° C. and said storing step is effected for about 1 to about 4 hours.

12. The method of claim 9 or 10 wherein said moisture content is about 50 to about 60% by weight.

13. The method of claim 9 or 10 wherein said mechanical fiberizing is effected at an initial temperature of about 10° to about 35° C.

14. The method of claim 13 wherein said mechanical fiberizing is effected at an initial temperature of about 15° to about 25° C.

15. A method of forming shredded tobacco stem, which comprises:

(a) exposing a mass of tobacco stem material to water having a temperature up to the boiling point thereof and having a volume sufficient to permit the desired moisture level to be achieved for about 5 to about 15 minutes at atmospheric pressure, thereby to permit said mass to soak up said water, (b) storing said exposed mass in a confined manner for about 0.25 to about 24 hours to permit said soaked up water to permeate through and into the tobacco stem material and evenly distribute therethrough and provide an overall moisture content of about 50 to about 60% by weight, (c) mechanically fiberizing said soaked mass of tobacco stem material between counter-rotating disc-like fiberizing surfaces maintained from about 0.05 to about 0.3 inches apart at atmospheric pressure at an initial temperature of about 15° to about 25° C., and (d) drying the fiberized stem material so formed to a moisture content of about 10 to about 16 wt.%.

16. The method of claim 9 or 15, including discharging said fiberized stem material directly into a flowing air stream to maintain said fibres in a substantially separated condition, and separating said fiberized stem from the air stream.

17. The method of claim 16 wherein said flowing air stream has a temperature below that of the fiberized stem material thereby cooling said fiberized stem during flow in said air stream.

18. The method of claim 7, 9 or 15 wherein the spacing between said fiberizing surfaces is about 0.13 to about 0.3 inches.

19. The method of claim 7, 9 or 15 wherein the spacing between said fiberizing surfaces is about 0.13 to about 0.18 inches.

20. The method of claim 9 or 15 wherein said drying step is effected in two stages, initially to a moisture content of about 19 to about 35 wt.%, and subsequently to said moisture content of about 10 to about 16 wt %.

21. The method of claim 20 including, subsequent to said initial drying, blending the partially-dried fiberized stem material with shredded tobacco lamina in the proportion of about 2 to about 50% by weight of partially-dried fiberized stem material, and then drying the blend to said moisture content of about 10 to about 16 wt.%.

22. A method of forming shredded tobacco stem, which comprises:

(a) soaking a mass of tobacco stem material in water at atmospheric pressure to provide a substantially uniform distribution of water therethrough at a moisture level of about 30 to about 60% by weight in such manner as to avoid any substantial loss of water extractibles from said mass, (b) mechanically fiberizing said soaked mass of tobacco stem material between two counter-rotating disc-like fiberizing surfaces spaced apart about 0.05 to about 0.3 inches; said fiberizing being effected at atmospheric pressure and at a temperature up to the boiling point of water, (c) discharging the fiberized stem material directly into a flowing air stream to maintain said fibres in a substantially separated condition, (d) separating said fiberized stem material from the air stream, (e) drying said separated fiberized stem material to a moisture content of about 19 to about 35 wt.%, (f) winnowing heavy fragments from the fiberized stem material, and (g) drying the winnowed stem material to a moisture content of about 10 to about 16 wt.%.

23. The method of claim 22 including, subsequent to said winnowing step, blending said winnowed fiberized stem with shredded tobacco lamina in the proportion of about 2 to about 50% by weight of winnowed stem, and drying the blend to said moisture content of about 10 to about 16 wt.%.

24. A method of forming shredded tobacco stem, which comprises:

(a) exposing a mass of tobacco stem material to water, having a temperature up to the boiling point thereof and having a volume sufficient to permit the desired moisture level to be achieved, for about 5 to about 15 minutes at atmopsheric pressure, thereby to permit said mass to soak up said water, (b) storing said exposed mass in a confined manner for about 0.25 to about 24 hours to permit said soaked up water to permeate through and into the tobacco stem material and evenly distribute therethrough and provide an overall moisture content of about 50 to about 60% by weight, (c) mechanically fiberizing said soaked mass of tobacco stem material between counter-rotating disc-like fiberizing surfaces maintained from about 0.05 to about 0.3 inches apart at atmospheric pressure and at an initial temperature of about 15° to about 25° C., (d) discharging said fiberized stem material directly into a flowing air stream to maintain said fibres in a substantially separated condition, (e) separating said fiberized stem material from the air stream, (f) drying said separated fiberized stem material to a moisture content of about 19 to about 35 wt.%, (g) winnowing heavy fragments from the fiberized stem, and (h) drying the winnowed stem material to a moisture content of about 10 to about 16 wt.%.

25. The method of claim 24 including, subsequent to said winnowing step, blending said winnowed fiberized stem material with shredded tobacco lamina in the proportion of about 2 to about 50% by weight of winnowed stem material, and drying the blend to said moisture content of about 10 to about 16 wt.%.

* * * * *